US007373880B2

(12) United States Patent
Niemiro

(10) Patent No.: US 7,373,880 B2
(45) Date of Patent: May 20, 2008

(54) VARIABLE FORMAT OFFSET PRINTING PRESS

(75) Inventor: Thaddeus A. Niemiro, Lisle, IL (US)

(73) Assignee: Goss International Corporation, Bolingbrook, IL (US)

( * ) Notice: Subject to any disclaimer, the term of this patent is extended or adjusted under 35 U.S.C. 154(b) by 0 days.

(21) Appl. No.: 11/657,837

(22) Filed: Jan. 23, 2007

(65) Prior Publication Data

US 2007/0119318 A1 May 31, 2007

Related U.S. Application Data

(62) Division of application No. 10/865,581, filed on Jun. 9, 2004, now Pat. No. 7,171,900.

(51) Int. Cl.
*B41F 13/14* (2006.01)

(52) U.S. Cl. ..... 101/248; 101/180; 101/181; 101/220; 101/221

(58) Field of Classification Search ..... 101/217, 101/248, 180, 181, 228, 220, 221, 177, 142, 101/178, 179
See application file for complete search history.

(56) References Cited

U.S. PATENT DOCUMENTS

| | | | |
|---|---|---|---|
| 3,308,752 | A | 3/1967 | Stevenson |
| 3,750,568 | A | 8/1973 | Weisgerber |
| 4,119,032 | A | 10/1978 | Hollis |
| 4,332,194 | A | 6/1982 | Gensheimer |
| 4,336,755 | A | 6/1982 | Liska et al. |
| 4,487,124 | A | 12/1984 | Köbler et al. |
| 4,559,755 | A | 12/1985 | Romagnoli |
| 4,738,200 | A | 4/1988 | Stöckl et al. |
| 4,739,702 | A | 4/1988 | Kobler |
| 4,739,703 | A | 4/1988 | Eguchi et al. |
| 4,785,514 | A | 11/1988 | Kannwischer et al. |
| 4,807,527 | A | 2/1989 | Knauer |
| 4,817,525 | A | 4/1989 | Yagi et al. |

(Continued)

FOREIGN PATENT DOCUMENTS

| | | |
|---|---|---|
| DE | 4104209 | 8/1992 |

(Continued)

OTHER PUBLICATIONS

Written Opinion of the International Searching Authority for International Application No. PCT/US2004/018726 dated Mar. 18, 2005.

(Continued)

*Primary Examiner*—Daniel J. Colilla
*Assistant Examiner*—Kevin D. Williams
(74) *Attorney, Agent, or Firm*—Marshall, Gestein & Borun LLP

(57) ABSTRACT

A printing press includes a frame that supports one or more printing units. Each printing unit includes a retractable inker module cantileverly supported by the frame, an ink injection system having a pump, a sidelay registration mechanism for one or more plate cylinders of the printing unit, an extension sleeve extending a length of a plate cylinder sleeve, and an expandable layer for each blanket cylinder and plate cylinder that provides changing the inner diameter of the blanket cylinder and the plate cylinder.

10 Claims, 9 Drawing Sheets

U.S. PATENT DOCUMENTS

| | | | |
|---|---|---|---|
| 4,887,533 | A | 12/1989 | Lemaster et al. |
| 4,895,072 | A | 1/1990 | Rich et al. |
| 5,027,706 | A | 7/1991 | Niemiro et al. |
| RE33,944 | E | 6/1992 | Knauer |
| 5,215,013 | A | 6/1993 | Vrotacoe et al. |
| 5,235,909 | A | 8/1993 | Gerstenberger et al. |
| 5,289,769 | A | 3/1994 | Lewis et al. |
| 5,595,117 | A | 1/1997 | Chrigui |
| 5,596,931 | A | 1/1997 | Rössler et al. |
| 5,613,438 | A | 3/1997 | Rehberg |
| 5,617,789 | A | 4/1997 | Achelpohl et al. |
| 5,647,673 | A | 7/1997 | Grundke et al. |
| 5,654,100 | A | 8/1997 | Köbler et al. |
| 5,704,288 | A | 1/1998 | John |
| 5,711,222 | A | 1/1998 | Taylor et al. |
| 5,735,206 | A | 4/1998 | Rossini |
| 5,740,738 | A | 4/1998 | Niemiro |
| 5,802,975 | A | 9/1998 | Prem et al. |
| 5,816,154 | A | 10/1998 | Stuart |
| 5,832,829 | A | 11/1998 | Kolbe et al. |
| 6,110,093 | A | 8/2000 | Slusarz |
| 6,142,073 | A | 11/2000 | Zeman et al. |
| 6,247,406 | B1 | 6/2001 | D'Annunzio et al. |
| 6,318,257 | B1 | 11/2001 | Niemiro et al. |
| 6,343,547 | B1 | 2/2002 | Callahan et al. |
| 6,394,943 | B1 | 5/2002 | Cormier et al. |
| 6,401,620 | B1 | 6/2002 | Buck et al. |
| 6,408,748 | B1 | 6/2002 | Hajek et al. |
| 6,408,756 | B1 | 6/2002 | D'Annunzio et al. |
| 6,419,794 | B2 | 7/2002 | Kustermann |
| 6,513,430 | B1 | 2/2003 | Atwater |
| 6,516,721 | B1 | 2/2003 | Voge |
| 6,901,854 | B2 * | 6/2005 | Masuch ..... 101/216 |
| 2004/0144273 | A1 * | 7/2004 | Kersch et al. ..... 101/248 |

FOREIGN PATENT DOCUMENTS

| | | |
|---|---|---|
| DE | 4341246 | 2/1995 |
| EP | 0955164 | 11/1999 |
| EP | 1149694 | 10/2001 |
| GB | 263385 | 12/1926 |
| WO | WO-96/20835 | 7/1996 |

OTHER PUBLICATIONS

International Search Report in International Application No. PCT/US2004/018726 dated Mar. 18, 2005.

* cited by examiner

VARIABLE FORMAT OFFSET PRINTING PRESS

RELATED APPLICATIONS

This application is a divisional application of U.S. patent application Ser. No. 10/865,581, filed Jun. 9, 2004, which claims priority benefit under 35 U.S.C. §119(e) of U.S. provisional application Ser. No. 60/477,116, filed Jun. 9, 2003. Both U.S. Ser. No. 10/685,581 and U.S. Ser. No. 60/477,116 are hereby incorporated by reference.

FIELD OF THE DISCLOSURE

The present invention relates generally to printing presses and, more particularly, to variable format offset printing presses and components for such presses.

BACKGROUND OF THE DISCLOSURE

Conventional offset printing presses typically comprise a rotationally supported plate cylinder, a blanket cylinder and an impression cylinder. Ink or emulsion ink is supplied to the image area of the plate cylinder(s), from where it is transferred to the blanket cylinder and ultimately to the paper or paper web running between the blanket cylinder and the impression cylinder. As is known, by placing blanket cylinders on both sides of the paper, images may be applied to both sides of the paper simultaneously, often referred to as perfect printing.

Typically, the cylinders are formed by turning the ends of solid metal cylinders to form journals, with the journals at each end including bearings which, in turn, are mounted in support frames on each end of the cylinders. Also, typically, each blanket cylinder is wrapped with a flexible blanket sheet having a pair of ends. The sheet is stretched around the cylinder such that the ends meet. The ends are then tucked into special retaining slits cut along the length of the blanket cylinder. The discontinuities in the cylinder caused by these slits and/or the resulting gap between the ends of the sheet cause vibration of the cylinders and other press components. These vibrations have a tendency to negatively impact the printed image and limit the speed of the press.

A conventional plate cylinder is constructed much like the blanket cylinder, with the exception that, instead of a blanket covering, the cylinder is clad with an image carrying plate. In order to secure the image plate to the cylinder, the underlying cylinder includes a lock up gap.

Typically, once the size of the blanket cylinder(s) and the plate cylinder(s) are chosen, the size of the resulting image cannot be changed without changing many of the press components including, for example, the cylinders, the driving gears, aspects of the supporting frame, and other components.

Conventionally the image plate is inked by a series of rubber rollers alternating with metallic or polymer covered rollers which oscillate laterally to better distribute ink. These rollers are driven by the gears mounted on the end of the cylinders. The cylinders and the inking rollers are supported at each end by the press frame.

DETAILED DESCRIPTION

Figure 1:
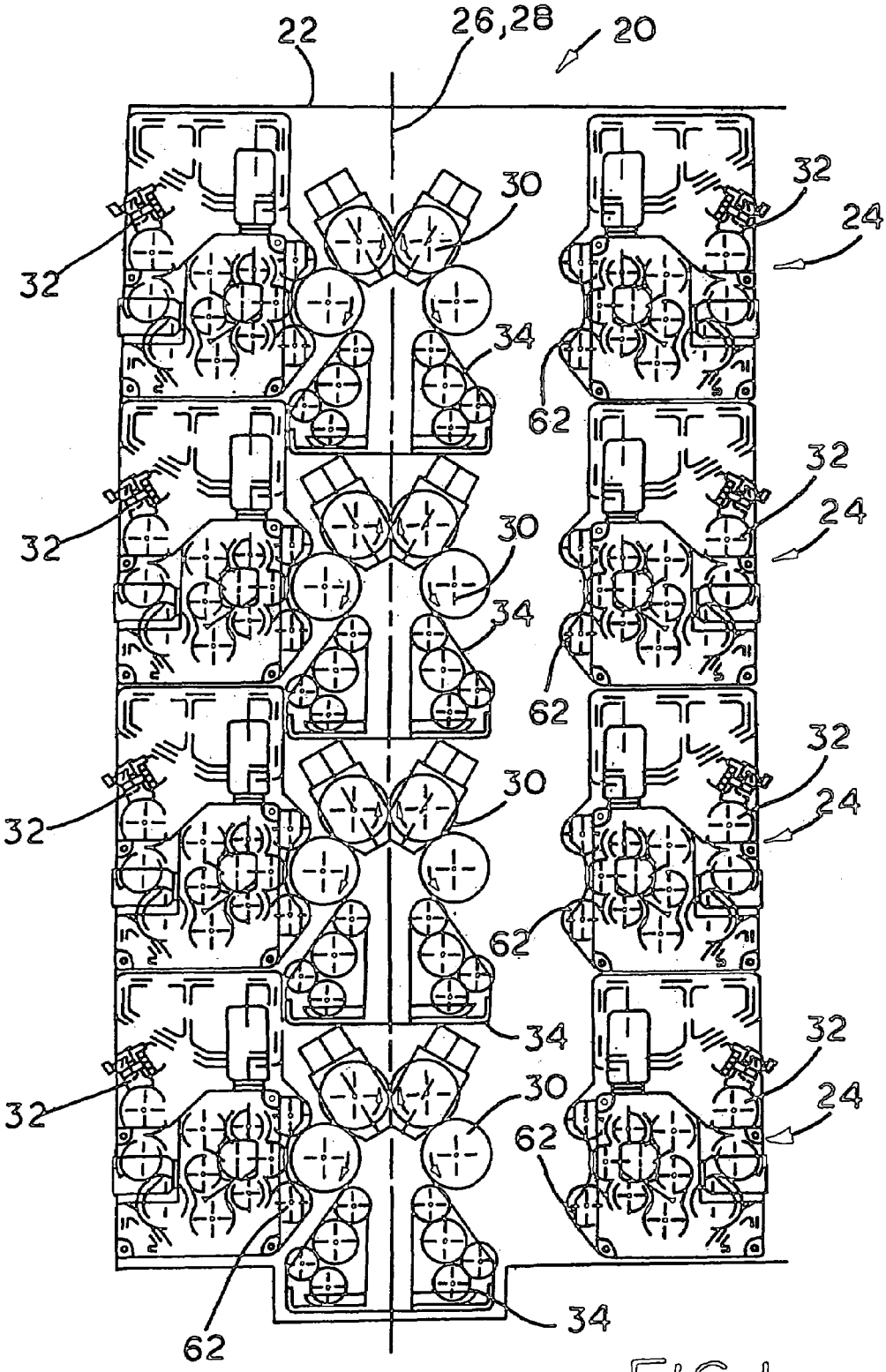
FIG. 1 is a schematic diagram of a printing press constructed in accordance with the teachings of the present disclosure.

Referring to FIG. 1, a printing press 20 constructed in accordance with the teachings of the present disclosure is shown. The printing press 20 includes a frame 22 that supports one or more printing units 24. Although four printing units 24 are shown in FIG. 1, the printing press 20 can include as few as one printing unit 24 or as many printing units 24 that may be necessary to provide a particular printing operation. Each printing unit 24 preferably is symmetric about a central axis 26 that generally defines a path of paper 28. To print on each side of the paper 28 that traverses along the central axis 26, each printing unit 24 includes a printing module 30, an inker module 32, and a dampener module 34 on each side of the central axis 26. Each inker module 32 engages its corresponding printing module 30 during printing to provide ink to the printing module 30. The dampener module 34 provides water solution for a lithographic printing process to occur.

Figure 2:
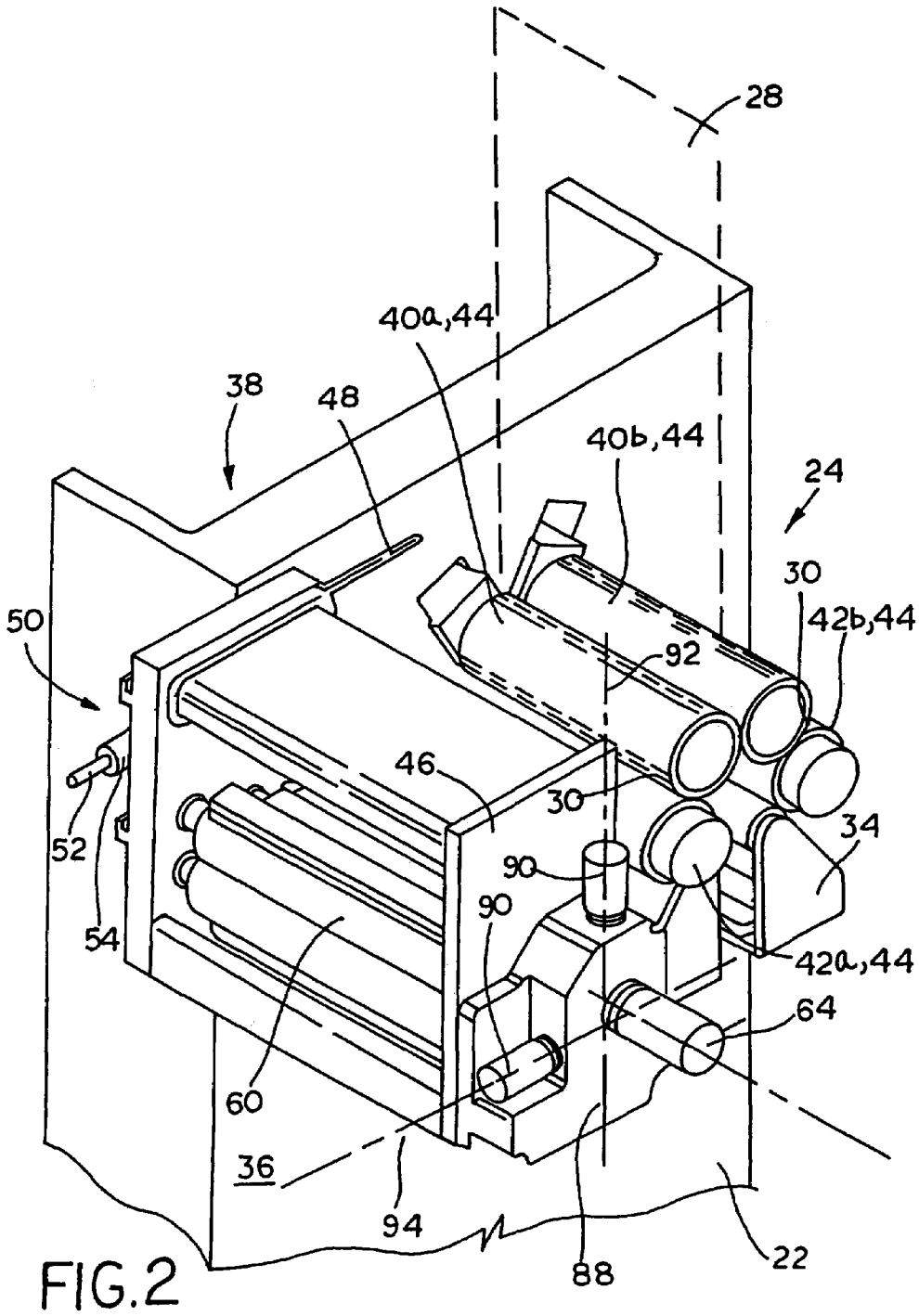
FIG. 2 is a perspective view of a printing unit of the printing press of FIG. 1.

Referring to FIG. 2, one of the printing units 24 is shown in detail with only one of its inker modules 32. The printing unit 24 has an operation side 36, where the press make ready operations are performed. The printing unit 24 also has a drive side 38, where the drive mechanism of the various components that will be described in the following text may be positioned. The frame 22 divides the operation side 36 and the drive side 38 and supports the herein described components of the printing unit 24. The printing module 30 may include a pair of blanket cylinders 40*a* and 40*b* and a pair of corresponding plate cylinders 42*a* and 42*b*. In accordance with the disclosed example, each of the blanket cylinders 40*a* and 40*b*, and each of the plate cylinders 42*a* and 42*b* is rotationally and cantileverly supported by the frame 22.

Each plate cylinder 42*a* and 42*b* is in contact with a corresponding inker module 32, from which it receives ink in controlled amounts. Each plate cylinder 42*a* and 42*b* is in rotational contact with a corresponding blanket cylinder 40*a* and 40*b*, respectively. Accordingly, each plate cylinder 42*a* and 42*b* transfers ink from the outer surface thereof to the outer surface of the corresponding blanket cylinder 40*a* and 40*b*, respectively. The outer surface of each plate cylinder 42*a* and 42*b* includes an image that is transferred by the ink on the outer surface of each plate cylinder 42*a* and 42*b* to the outer surface of the corresponding blanket cylinder 40*a* and 40*b*, respectively. When the blanket cylinders 40*a* and 40*b* rotate opposite each other to contact the web of the paper 28 traversing along the central axis 26 between the two blanket cylinders 40*a* and 40*b*, the outer surfaces of the blanket cylinders 40*a* and 40*b* impart the images onto each side of the paper 28, respectively.

The inker module 32 (only one inker module 32 is shown in FIG. 2) provides ink to the plate cylinder 42*a* during printing. It will be understood that additional similar or dissimilar inker modules may be provided. The inker module 32 includes an inker module frame 46 that is movably mounted to the frame 22 so as to be able to move toward and away from the printing module 30. Accordingly, the inker module frame 46 can move between an operatively engaged position, where the inker module 32 can operatively engage the printing module 30, and a retracted position (shown in FIG. 2), where the inker module 32 is disengaged from the printing module 30. Retracting the inker module 32 from the printing module 30 allows an operator to access to the printing module 30 for print format changes.

The frame 22 includes a bearing way 48 or other suitable path or track by which the inker module frame 46 is movably and cantileverly supported on the frame 22. In accordance with the disclosed example the bearing way 48 is linear. However, the bearing way 48 may be curved, be curvilinear, or have any other suitable path shape. The bearing way 48 movably supports the inker module frame 46, by using known bearing components or other suitable methods. For example, the inker module frame 46 can include an array of bearing supported rollers (not shown) that can be securely housed in the bearing way 48. Accordingly, the bearing way 48 can function as a track for the bearing supported rollers to provide moving of the inker module frame 46 between the operatively engaged and retracted positions.

To provide powered and controllable movement of the inker module frame 46 relative to the printing module 30, the frame 22 includes a drive screw mechanism 50. The drive screw mechanism 50 includes a screw 52 that is positioned parallel with the bearing way 48 and is coupled to a motor (not shown) so as to rotate in place when desired. The inker module frame 46 includes an internally threaded sleeve 54 through which the screw 52 traverses. Accordingly, by turning the screw 52 with the motor (not shown), the inker module 32 can be moved between the operatively engaged position and the retracted position. Other mechanisms may be utilized to operatively engage and retract the inker module 32.

Figures 3, 4:
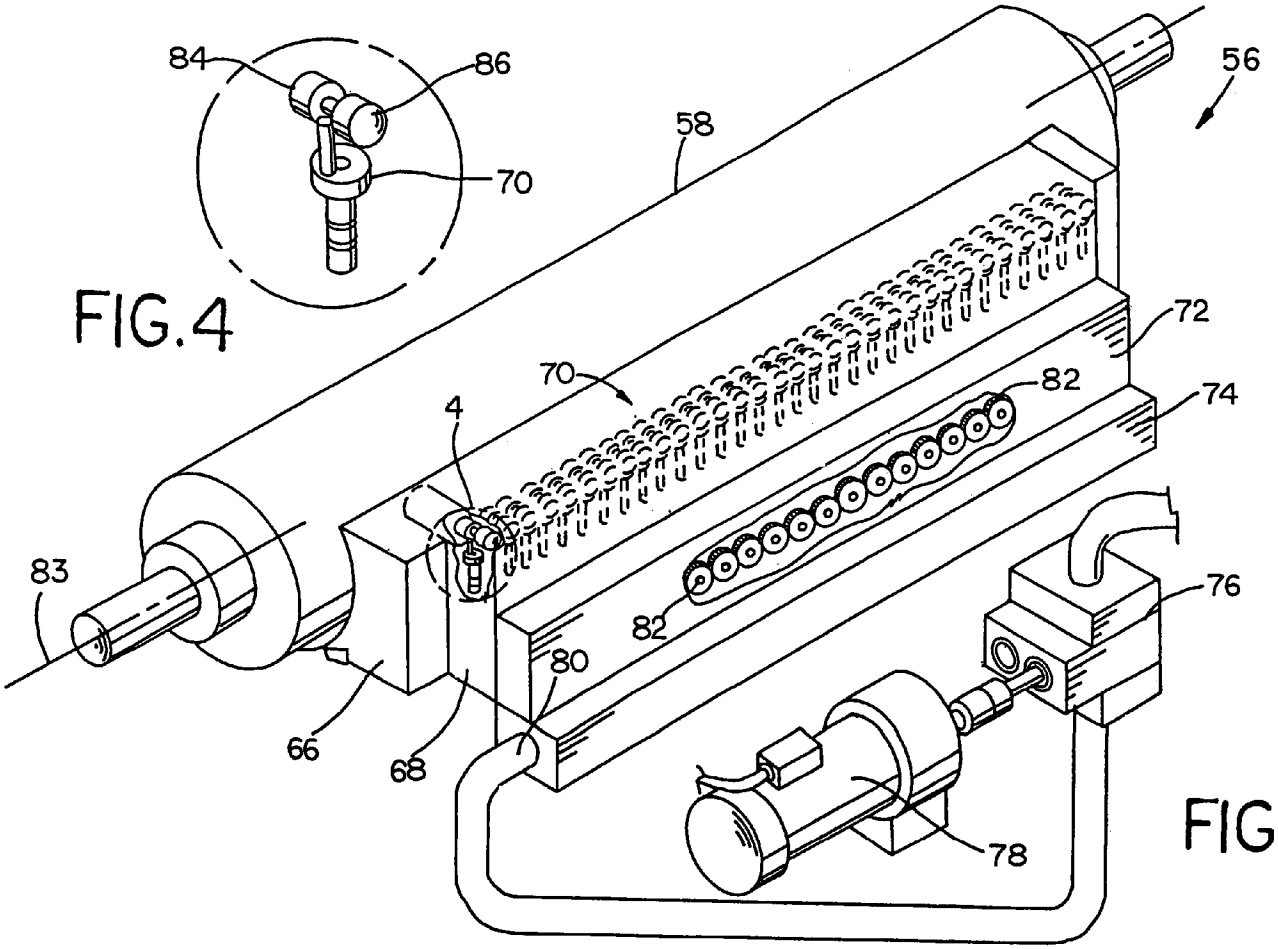
FIG. 3 is a perspective view of an ink injection system constructed in accordance with the teachings of the present disclosure.
FIG. 4 is an enlarged view of region 4 of FIG. 3.

The inker module 32 may include an ink injection system 56 (shown in FIG. 3) that transfers ink to a fountain roller 58 (shown in FIG. 3). The fountain roller 58 may be coupled to a plurality of ink transfer rollers 60, which transfer the ink from the fountain roller 58 to a form roller 62 (shown in FIG. 1). The form roller 62 may be rotationally coupled to the plate cylinder 42*a* to transfer ink to the blanket cylinder 42*a*, which can in turn transfer the ink to the plate cylinder 40*a*. The ink transfer rollers 60 may function to control the amount of ink being transferred from the fountain roller 58 to the form roller 62 and to control the distribution of ink on the form roller 62. The fountain roller 58, the ink transfer rollers 60, and the form roller 62, may be driven by an inker module drive motor 64.

Figure 5:
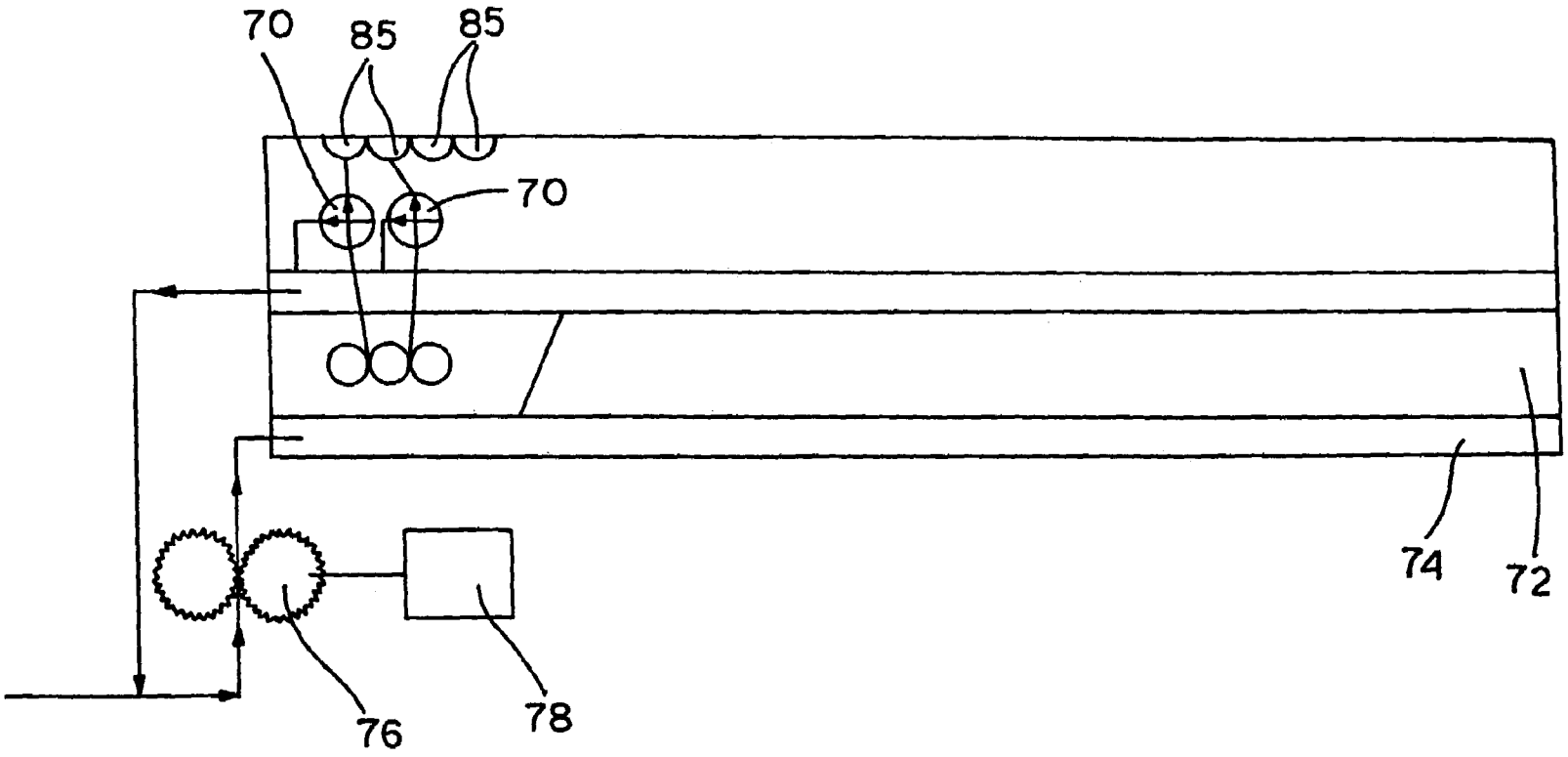
FIG. 5 is schematic view of the ink injection system of FIG. 3.

Referring to FIGS. 3-5, the ink injection system 56 of the inker module 32 is shown in detail. The ink injection system 56 includes an ink rail 66, an ink valve housing 68 that is connected to the ink rail 66 and includes a plurality of ink valves 70, a flow divider assembly 72 that is connected to the ink valve housing 68, an ink supply manifold 74 that is connected to the flow divider assembly 72, and an ink pump 76 to pump ink from an ink supply (not shown) to the ink supply manifold 74.

The ink pump 76 provides a pressurized ink supply to the ink supply manifold 74. The ink pump 76 can be driven by an ink pump drive 78. The ink supply manifold 74 receives the pressurized ink from a manifold input 80 and provides the pressurized ink to the entire span of the flow divider assembly 72. The flow divider assembly 72 includes a plurality of gears 82 that are daisy chained together and are free to rotate, i.e., passive gears. The gears 82 function as positive displacement pumps that move proportionally to the volume of the pressurized ink. Additionally, because the gears 82 are linearly coupled to each other, the gears 82 collectively functions as a precision flow divider. In other words, when one gear 82 turns, all the gears 82 will turn the same amount. Accordingly, the gears 82 divide the flow along the span of the flow divider assembly 72 regardless of the pressure of the ink. Thus, the flow divider assembly 72 provides a substantially uniform flow of ink to the valves 70.

The ink rail 66 is positioned adjacent the fountain roller 58 and may be aligned with the longitudinal axis 83 of the fountain roller 58. The ink rail 66 provides transfer of ink on the fountain roller 58 in columns 85 (shown in FIG. 5) through ink orifices (not shown) which correspond to the columns 85. Each ink orifice (not shown) corresponds to one of the ink valves 70. Accordingly, the number of ink valves 70 corresponds to the number of ink columns 85 deposited on the fountain roller 58. As shown in FIG. 4, each ink valve 70 is operable by a pair of solenoid coils 84 and 86. One of the solenoid coils 84 actuates the corresponding ink valve 84, while the other solenoid coil 86 provides the return of the ink valve 70 to the non-actuated position. As shown in FIG. 4, the ink in each ink valve 70 is routed back to the flow divider assembly 72 when the ink valve 70 is in the non-actuated position. Alternately, each ink valve 70 can be actuated by compressed air, the supply of which to the ink valve 70 may be then controlled by the solenoid coils 84 and 86. Alternately yet, each ink valve 70 can be operable with a single solenoid that actuates the valve and a return spring that returns the valve to the non-actuated position.

When the solenoid 84 is powered, the ink valve 70 is placed in the "on" position, thereby directing ink from the ink valve housing 68 to the ink rail 66. The ink rail 66 directs the ink through the corresponding orifice (not shown) to then be deposited on the fountain roller 58. When the solenoid 84 is not powered, the solenoid 86 is powered to return and maintain the valve 70 in the "off" position. When in the "off" position, the valve 70 does not direct ink to the ink rail 66, but bypasses the ink back to a suction side of the ink manifold 74.

The printing press 20 may include a control system (not shown) that operates the ink valves 70. In operation, the ink valves 70 are turned on and off at a controlled pulse rate, and the "on" time is controlled as a function of print density. For example, if the printing is of high density that requires a great deal of ink, then the control system will cause the ink valves 70 to be opened a length of time that will supply more ink to the ink rail 66 in the given column than it would for a column that is of light print density. The ink injection system 56 is a digital system that supplies the ink to the fountain roller 58 in a timed series of bursts. The operation of the ink valves 70 and the method by which the ink valves deposit ink on the fountain roller 58 are disclosed in U.S. Pat. No. 5,027,706, which is incorporated herein by reference.

To distribute the ink during transfer thereof from the fountain roller 58 to the form roller 62, the ink transfer rollers 60 may be vibrated by gears or by being mounted on eccentric bearings (not shown). Accordingly, the vibration of the ink transfer rollers 60 is dependent on the eccentricity of the bearings and proportional to the rotation speed of the ink transfer rollers 60. However, referring to FIG. 2, to provide controlled vibration of the ink transfer rollers independent of the speed of the ink transfer rollers 60 or any eccentric bearings or gears onto which the ink transfer rollers 60 may be mounted, the inker module 32 includes a vibration module 88. The vibration module 88 is attached to the inker module frame 46 and includes a pair of oscillation motors 90. The vibration module 88 also houses the inker module drive motor 64. Each oscillation motor 90 provides oscillation of the ink transfer rollers 60 along one of the two non-rotational axes 92 and 94 of the ink transfer rollers 60. Accordingly, as shown in FIG. 2, each oscillation motor 90 is mounted to the inker module frame 46 along a corresponding non-rotational axis 92 and 94, respectively.

Operation variables of each oscillation motor 90 can be adjusted to impart particular vibration characteristics on the ink transfer rollers 60. Such operation variables can include motor speed, vibration amplitude and phase. Additionally, phase relationship between the vibrations generated by the oscillation motors 90 can be an additional operation variable that provides control over the oscillation of the ink transfer rollers 60. The phasing variability of the ink transfer rollers 60 can minimize the lateral inertia forces acting on a frame 22. The printing press 20 can include a control system (not shown) that can control the above-described variables of each of the oscillation motors 90 to provide particular vibration characteristics for the ink transfer rollers 60.

Figure 6:
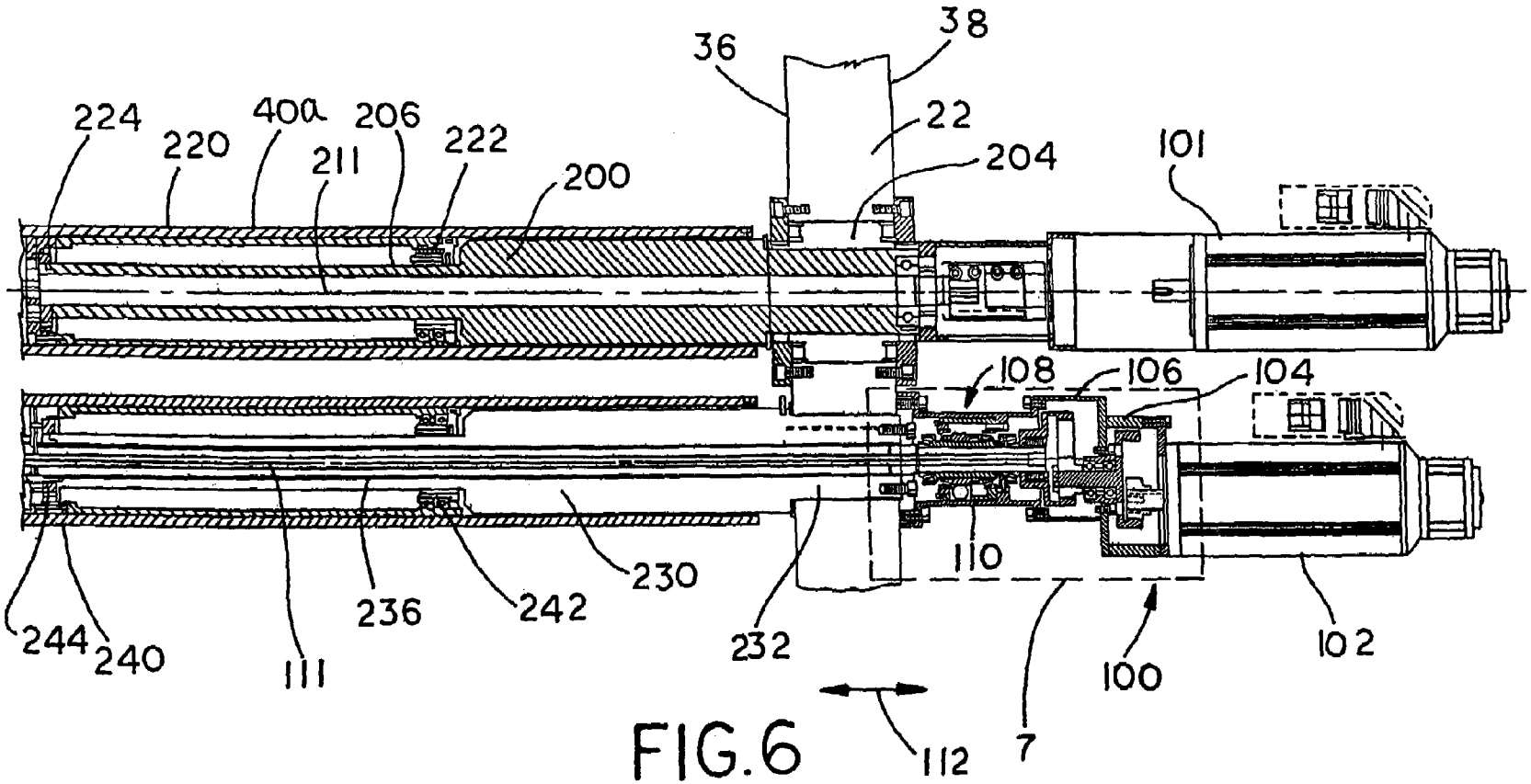
FIG. 6 is cross-sectional view of the printing unit of FIG. 2 including a sidelay registration mechanism constructed in accordance with the teachings of the present disclosure.

Referring to FIG. 6, the plate cylinder 42*a* and its corresponding plate cylinder drive mechanism 100, and the blanket cylinder 40*a* and its corresponding blanket cylinder drive mechanism 101 are shown in detail. The drive mechanism 100 of the plate cylinder 42*a* includes a drive motor 102, a first gearbox 104, a second gearbox 106, and a sidelay registration mechanism 108, which is housed in a sidelay enclosure 110. The drive motor 102 powers the rotation of a plate cylinder shaft 111 through the first gear box 104, the second gear box 106 and the sidelay registration mechanism 108.

The drive mechanism 100 is supported by the frame 22 in a cantilever manner by each of the above-noted components of the drive mechanism 100 being mounted to the frame 22 and each other as follows: the sidelay enclosure 110 is mounted to the frame 22; the second gearbox 106 is mounted to the sidelay enclosure 110; the first gearbox 104 is mounted to the second gearbox 106; and, the drive motor 102 is mounted to the first gearbox 104. As will be described below, the first gearbox 104 and the second gearbox 106 reduce the speed of the drive motor 102, while the sidelay registration mechanism 108 provides side-to-side registration of the plate cylinder 42*a* as shown in FIG. 6 by the arrows 112.

Figure 7:
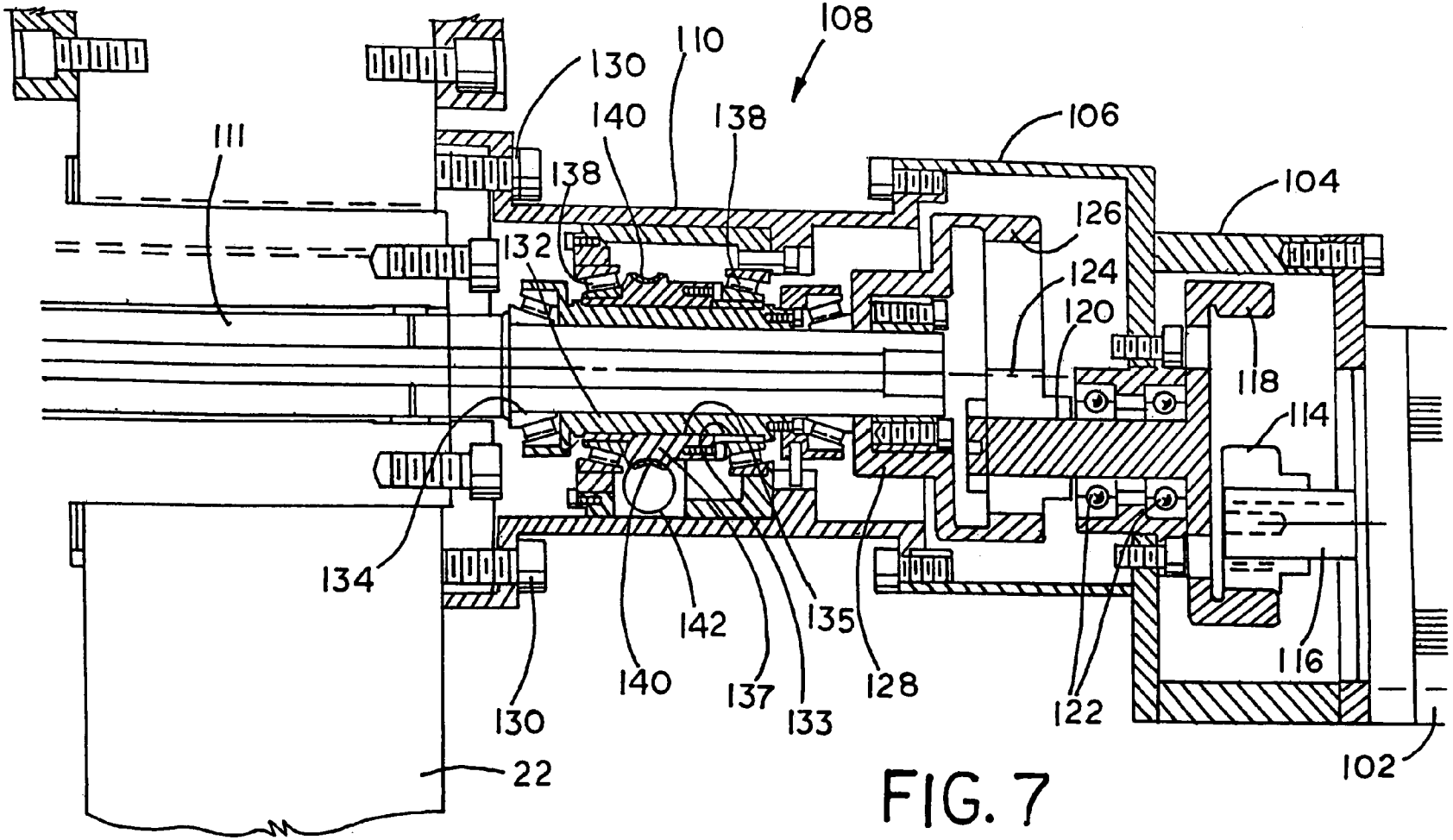
FIG. 7 is an enlarged view of region 7 of FIG. 6.

Referring to FIG. 7, the first gearbox 104 includes a first transfer gear 114 that is mounted to a motor shaft 116 of the drive motor 102. The first transfer gear 114 engages a first ring gear 118 having a larger diameter than the diameter of the first transfer gear 114. Accordingly the first gearbox 104 reduces the shaft speed by a ratio of the diameter of the first ring gear 118 to the diameter of the first transfer gear 114. In the disclosed examples, the first gearbox provides a two to one speed reduction. The first ring gear 118 is coupled to a transfer shaft 120. The transfer shaft 120 extends through the second gearbox 106 and is rotatably supported by the second gearbox 106 with a pair of bearings 122. The transfer shaft 120 includes a second transfer gear 124 that engages a second ring gear 126 having a larger diameter than the diameter of the second transfer gear 124. Accordingly the second gearbox 106 additionally reduces the shaft speed by a ratio of the diameter of the second ring gear 126 to the diameter of the second transfer gear 124. In the disclosed examples, the second gearbox provides a two to one speed reduction. The second ring gear 126 transitions to a transition collar 128, which extends inside the sidelay enclosure 110 and is mounted to a plate cylinder shaft 111 so as to rotate the plate cylinder shaft 111. Thus, the first gearbox 104 and the second gearbox 106 collectively transfer the rotation of the motor shaft 116 to the plate cylinder shaft 111 by four to one speed reduction.

The sidelay registration mechanism 108 will now be described in detail. The sidelay enclosure 110 is mounted to the frame 22 with bolts 130. A first race 132 is rotatably mounted to the plate cylinder shaft 111 with a pair of spaced apart first tapered roller bearings 134. The first bearings 134 allow the first race 132 to rotate relative to the plate cylinder shaft 111, but prevent the first race 132 from moving in any other direction relative to the plate cylinder shaft 111. In other words, the plate cylinder shaft 111 and the first race 132 are locked and move together when moving from side to side. An outer surface 133 of the first race 132 is longitudinally threaded and engages a correspondingly threaded inner surface 135 of a second race 137. The second race 137 is rotatably coupled to the sidelay enclosure 110 with a pair of spaced apart second tapered roller bearings 138. Accordingly, the second race 137 can rotate relative to the sidelay enclosure 110 but cannot move from side to side relative to the sidelay enclosure 110. Accordingly, rotation of the second race 137 causes the first race 132 move from side-to-side as shown by the arrows 112.

The sidelay registration mechanism 108 includes worm gear 140 that is rotatably mounted on the second race 137. The sidelay registration mechanism 108 further includes a screw 142 that engages the worm gear 140. Rotating the screw 142 causes the rotation of the worm gear 140. The rotation of the worm gear 140 in turn causes the rotation of the second race 137 about the plate cylinder shaft 111. Because of the above-described threaded coupling between the first race 132 and the second race 137, rotation of the second race 137 causes sideway movement of the first race 132 as shown by the arrows 112, with the direction of the sideway movement depending on the turning direction of the screw 142.

As described above, the first race 132 can rotate but cannot move from side to side about the plate cylinder shaft 111. Accordingly, sideway movement of the first race 132 also causes sideway movement of the plate cylinder shaft 111. Thus, by rotating the screw 142, the plate cylinder shaft 111 can be moved sideways so that the side position of the plate cylinder 42*a* relative to the blanket cylinder 40*a* can be adjusted. Furthermore, because all of the second ring gear 126, the second transfer gear 124 the transfer shaft 120, the first ring gear 118, the first transfer gear 114, and the drive motor 102 are coupled to the plate cylinder shaft 111, the noted coupled together components also move sideway with the plate cylinder shaft 111 while operational. The screw 142 can be coupled to a servo motor (not shown) to provide rotation of the screw 142 for the above-described sidelay registration of the plate cylinder 42*a*. Additionally, the sidelay registration mechanism 108 may include a control system coupled to the servo motor to provide precise side-to-side movement control of the plate cylinder shaft.

Referring to FIG. 6, blanket cylinder 40*a* includes a blanket cylinder mandrel 200 that has a base 202 that is cantileverly supported by the frame 22 with a set of linear bearings 204. The linear bearings 204 are arranged so that the blanket cylinders 40*a* and 40*b* can linearly move in the frame 22. The blanket cylinder mandrel 200 further includes a central bore 206 that supports a blanket cylinder shaft 211. The blanket cylinder shaft 211 rotates in the central bore 206 and is coupled to a blanket cylinder shell 220 with a set of first bearings 222 and a set of second bearings 224. The blanket cylinder shell 220 securely supports a blanket sleeve 226 (shown in FIG. 8). The plate cylinder 42*a* includes a plate cylinder mandrel 230 that has an eccentric base 232. The eccentric base 232 is cantileverly supported by the frame 22. The eccentric base 232 can be rotated when being mounted to the frame 22 to provide a desired position of the plate cylinder 42*a* relative to the frame. When the desired position of the plate cylinder 42*a* is achieved, the eccentric base is secured to the frame 22. The plate cylinder mandrel 230 further includes a central bore 236 that supports the plate cylinder shaft 111. The plate cylinder shaft 111 rotates in the central bore 236 and is coupled to a plate cylinder shell 240 with a set of first bearings 242 and a set of second bearings 244. The plate cylinder shell 240 securely supports a plate sleeve 246 (shown in FIG. 10). A more detailed description of the structural and operational features of the blanket cylinder 40*a* and the linear bearing 204, the plate cylinder 42*a*, and the above-described bearings 222, 224, 242 and 244 are disclosed in U.S. Pat. No. 6,318,257, which is incorporated herein by reference.

Figure 8:
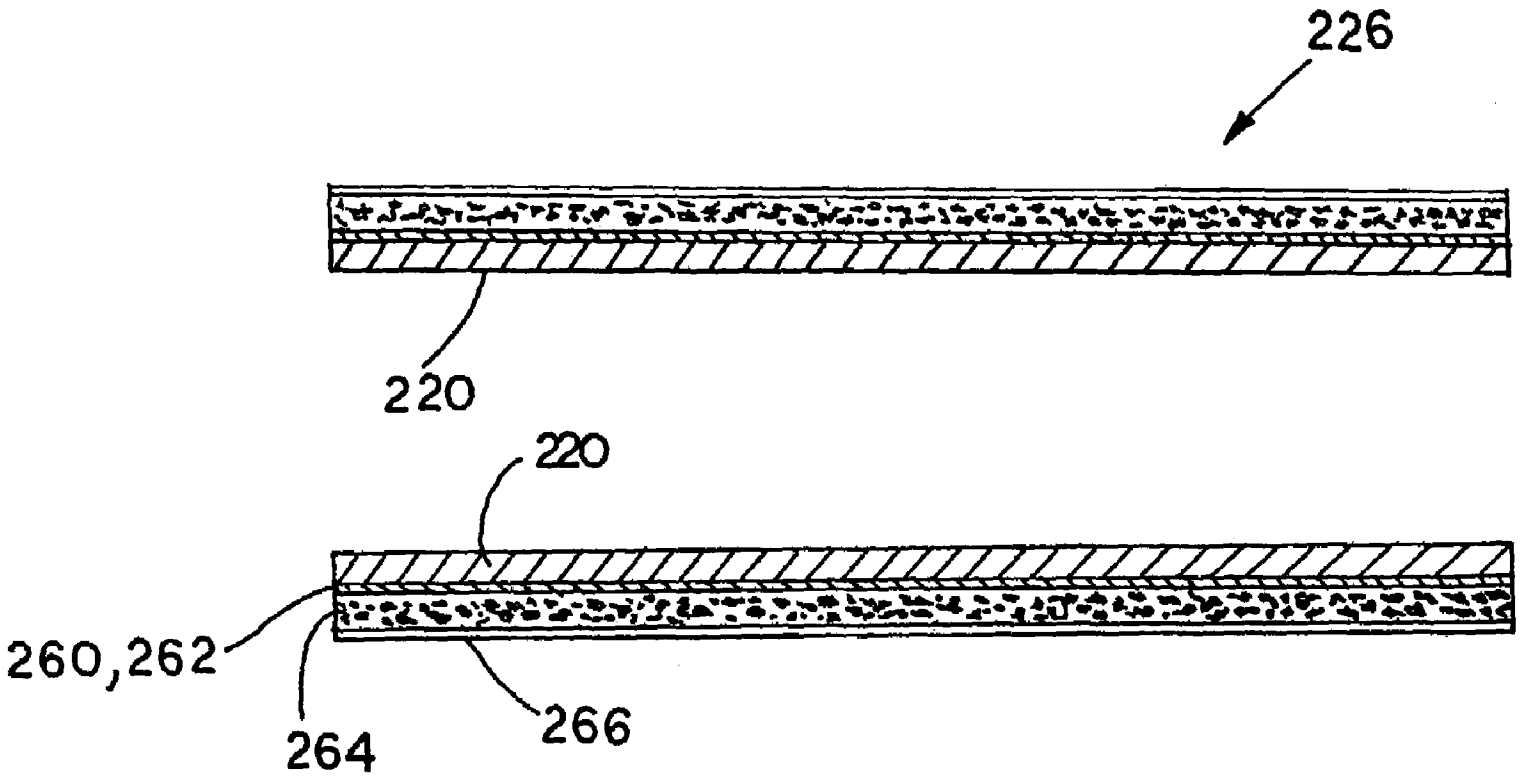
FIG. 8 is a side cross-sectional view of a blanket cylinder of the printing unit of FIG. 2.
Figure 10:
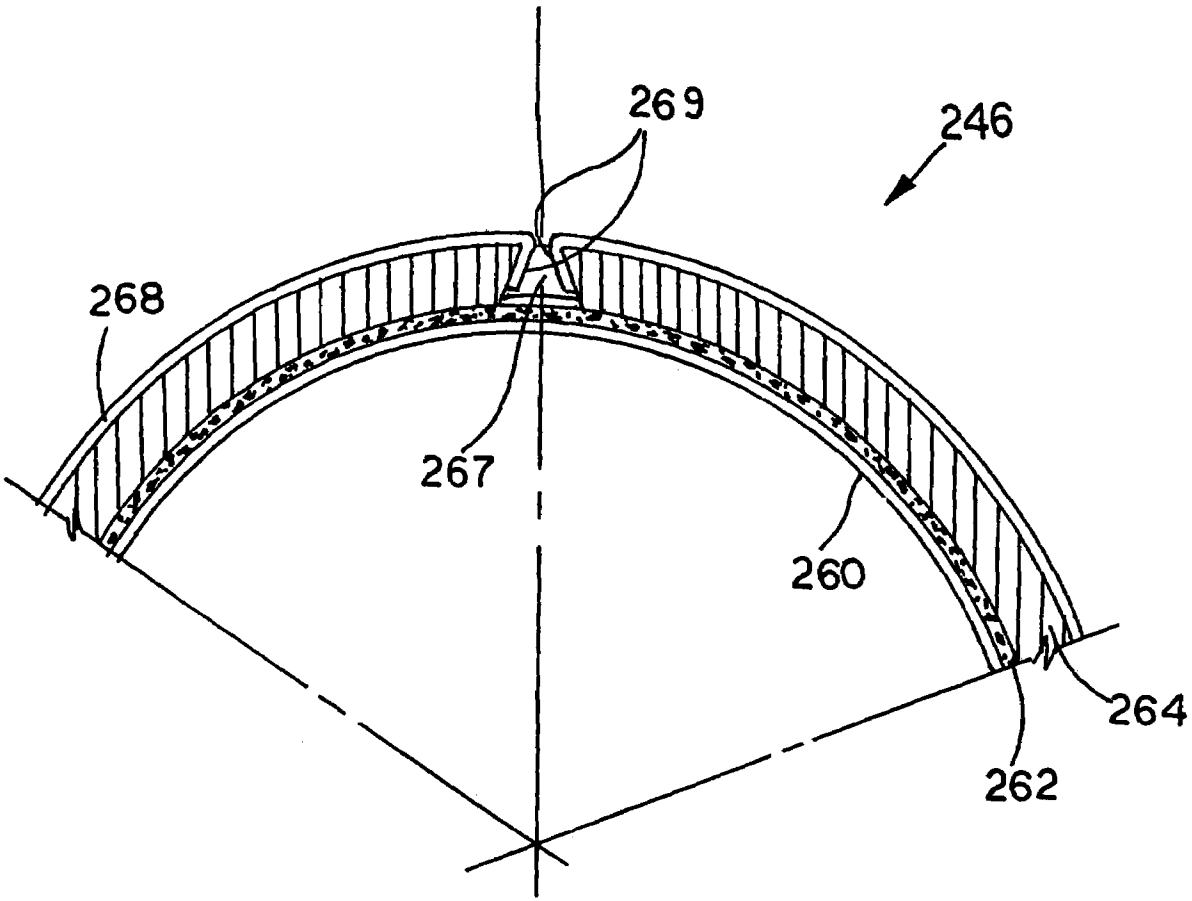
FIG. 10 is a front cross sectional view of a plate cylinder of the printing unit of FIG. 2.

Referring to FIGS. 8 and 10, the blanket sleeve 226 and the plate sleeve 246 are shown in detail, respectively. The blanket sleeve 226 includes an expandable layer 260, a compressible layer 262, a filler layer 264, and a blanket 266 as the outer layer. The plate sleeve 246 also includes the expandable layer 260, the compressible layer 262, and the filler layer 264. The plate sleeve 246, however, includes a plate 268 as the outer layer. The expandable layer 260 is expandable so as to provide variability of the inner diameter of the blanket sleeve 226 and the plate sleeve 246. As will become apparent in the following, such variability of the internal diameters of the blanket sleeve 226 and plate sleeve 246 allows the blanket sleeve 226 and plate sleeve 246 to be installed and removed from the blanket cylinder shell 220 and plate cylinder shell 240, respectively.

The expandable layer 260 can be constructed from an expandable material, such as fiberglass, polymers, or the like. In the disclosed example, the expandable layer 260 is constructed from fiberglass. The compressible layer 260 is constructed from a compressible material such as foam rubber. The compressible material 260 occupies the space in which the expandable layer 260 can expand to change the inner diameter of the blanket sleeve 226 and the plate sleeve 246. The material of the filler layer 264 should be stiff to support the blanket 266 or the plate 268 during printing operations. Accordingly, the filler layer 264 can be constructed from a stiff metal or plastic. By changing the thickness of the filler layer 264, the outside diameter of the blanket sleeve 226 or the plate sleeve 246 can be changed as desired. As shown in FIG. 10, the filler layer 264 of the plate sleeve 246 includes an inwardly expanding gap 267 for supporting inwardly angled ends 269 of the plate 268. Accordingly, the inwardly angled ends 269 of the plate 268 can be locked up in the gap 267 to securely mount the plate 268 to the filler layer 264.

Figure 9:
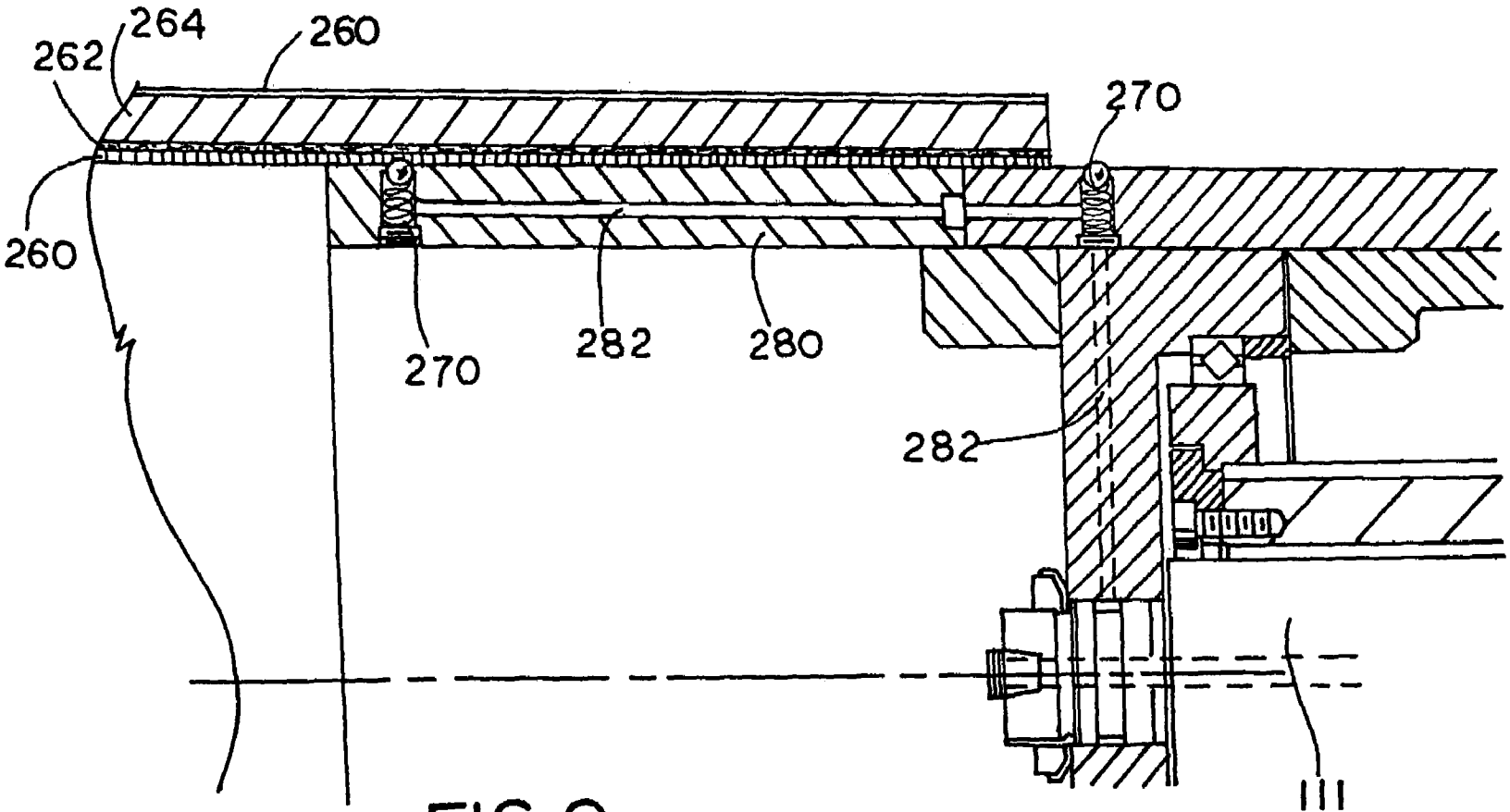
FIG. 9 is partial cross-sectional view of an extension sleeve for a plate cylinder constructed in accordance with the teachings of the present disclosure.

The inner diameter of blanket sleeve 226 is sized relative to the diameter of the blanket cylinder shell 220 so as to frictionally engage the blanket cylinder shell 220 for a secure mounting to the blanket cylinder shell 220 during operation. Similarly, the plate cylinder sleeve 246 is sized relative to the diameter of the plate cylinder shell 240 so as to frictionally engage the plate cylinder shell 240 for a secure mounting to the plate cylinder shell 240 during printing operation. The entire surface of the blanket cylinder shell 220 and the plate cylinder shell 240, or portions thereof, may include a plurality of air valves 270, an example of which is shown in FIG. 9. The air valves 270 are positioned flush with the surface of the blanket cylinder shell 220 and the plate cylinder shell 240. The air valves 270 are connected to a source of pressurized air, which in the disclosed example has a pressure of about 100 psi. Additionally, the air valves 270 may be check valves that remain open when the air from the source is allowed to flow to the air valves 270 and close when the air from the source of pressurized air is cut off.

The operation of the air valves 270 will only be described herein with respect to the plate cylinder shell 240 and the plate sleeve 246. However, such operation is similar with respect to the blanket cylinder shell 220. When pressurized air flows radially outward from each valve 270 of the plate cylinder shell 240, the pressure of the air expands the expandable layer 260 and opens a gap between the expandable layer 260 and the plate cylinder shell 240. In other words, the gap of air provides an air cushion between the expandable layer 260 and the plate cylinder shell 240. Accordingly, plate sleeve 246 can be slidably removed from the plate cylinder shell 240. When the supply of pressurized air to the valves 270 is cut off, the expandable layer 260 returns to its non-expanded configuration and tightly grips the surface of the plate cylinder shell 240. The frictional engagement of the expandable layer 260 with the plate cylinder shell 240 secures the plate sleeve 246 on the plate cylinder shell 240. Thus, by routing the pressurized air through the valves 270, the plate sleeve 246 can be installed and removed from the plate cylinder shell 240.

Referring to FIG. 9, the plate cylinder shell 240 may include an extension sleeve 280 that extends outward beyond the length of the plate cylinder shell 240. Accordingly, the plate sleeve 246 can be supported on the extension sleeve 280 when pulled completely outward from the plate cylinder shell 240. The extension sleeve 280 includes a plurality of air valves 270 and air conduits 282 that supply the air valves 270 with pressurized air. The extension sleeve 280 is simply an extension of the plate cylinder shell 240 and operates similar to the plate cylinder shell 240 as described above. The air conduits 282 may be connected to the source of pressurized air that is used for removal of the plate sleeve 246 from the plate cylinder shell 240 as described above.

When the plate sleeve 246 is disengaged from the plate cylinder shell 240 by pressurized air as described above, the plate sleeve 246 can be pulled out until the plate sleeve 246 is positioned just beyond the plate cylinder shell 240 and only supported by the extension sleeve 280. When the supply of pressurized air is cut off while the plate sleeve 246 is only supported by the extension sleeve 280, the plate sleeve 246 engages the extension sleeve 280 to secure the plate sleeve 246 on the extension sleeve 280. The extension sleeve 280 provides access to the entire plate sleeve 246 while securely supporting the plate sleeve 246 without having to remove the plate sleeve 246 from the plate cylinder shell 240. Accordingly, imaging operation of the plate sleeve 246 can be performed in a clean room environment while the plate sleeve 246 is entirely supported by the extension sleeve 280.

Persons of ordinary skill in the art will appreciate that, although the teachings of the present disclosure have been illustrated in connection with certain examples, there is no intent to limit the present disclosure to such examples. On the contrary, the intention of this application is to cover all modifications and examples fairly falling within the scope of the teachings of the present disclosure.

What is claimed is:

1. A printing press comprising:

a frame having an operation side and a drive side;

a plate cylinder cantileverly mounted to the operation side of the frame;

a blanket cylinder cantileverly mounted to the operation side of the frame;

a plate cylinder drive assembly mounted to the drive side of the frame and operatively coupled to the plate cylinder to rotate a shaft of the plate cylinder;

a blanket cylinder drive assembly mounted to the drive side of the frame and operatively coupled to the blanket cylinder to rotate a shaft of the blanket cylinder; and a sidelay registration mechanism coupled to the plate cylinder drive assembly, the sidelay registration mechanism operatively coupled to the shaft of the plate cylinder to provide side-to-side adjustment of the plate cylinder, the sidelay registration mechanism comprising:

a sidelay registration mechanism enclosure cantileverly mounted to the drive side of the frame, the sidelay registration mechanism enclosure housing a section of the shaft of the plate cylinder extending to the drive side;

a first race coupled to the shaft of the plate cylinder by a pair of spaced apart first tapered roller bearings, the first race including a threaded outer surface;

a second race coupled to the enclosure by a pair of spaced apart second tapered roller bearings, the second race including a threaded inner surface coupling the threaded outer surface of the first race; and a worm gear rotationally mounted on the second race and coupled to a drive screw, wherein rotation of the drive screw provides sideway movement of the shaft of the plate cylinder in the enclosure.

2. The printing press of claim 1, the plate cylinder drive assembly further comprising a gearbox assembly operatively coupled to a plate cylinder drive motor, the gearbox assembly coupling the plate cylinder drive motor to the shaft of the plate cylinder to transfer a rotational motion provided by the plate cylinder drive motor to the plate cylinder at a different speed than a rotational speed of the plate cylinder drive motor.

3. The printing press of claim 2, wherein the gear box assembly includes a first gearbox and a second gear box operatively coupled to each other.

4. The printing press of claim 2, wherein the sidelay registration mechanism is coupled to the gear box assembly and the plate cylinder drive motor, wherein a side-to-side adjustment of the plate cylinder by the sidelay registration mechanism provides a corresponding side-to-side adjustment of the gear box assembly and the plate cylinder drive motor.

5. The printing press of claim 1, comprising a servo motor coupled to the drive screw.

6. The printing press of claim 1, comprising a servo motor coupled to the drive screw and a control system to control the servo motor for side-to-side adjustment of the plate cylinder.

7. The printing press of claim 1, the blanket cylinder including a blanket sleeve removably mounted to a blanket cylinder shell and the plate cylinder including a plate sleeve removably mounted to a plate cylinder shell, wherein the blanket sleeve is removable from the blanket cylinder shell by pressurized air being supplied between the blanket sleeve and the blanket cylinder shell, and wherein the plate sleeve is removable from the plate cylinder shell by pressurized air being supplied between the plate sleeve and the plate cylinder shell.

8. The printing press of claim 7, the blanket sleeve comprising a plurality of layers including an inner expandable layer, a blanket to form an outer layer, a plurality of intermediate layers disposed between the expandable layer and the blanket layer, the intermediate layers including a compressible layer adjacent the expandable layer and a filler layer adjacent the compressible layer.

9. The printing press of claim 7, the plate sleeve comprising a plurality of layers including an inner expandable layer, a plate to form an outer layer, a plurality of intermediate layers disposed between the expandable layer and the plate layer, the intermediate layers including a compressible layer adjacent the expandable layer and a filler layer adjacent the compressible layer.

10. The printing press of claim 9, the plate including inwardly angled ends shaped to engage an inwardly expanding gap of the filler layer to secure the plate to the filler layer.

* * * * *